US008985209B2

(12) United States Patent
Gonzalez Martinez

(10) Patent No.: US 8,985,209 B2
(45) Date of Patent: Mar. 24, 2015

(54) HIGH PRESSURE JET PERFORATION SYSTEM

(75) Inventor: Carolina Gonzalez Martinez, Bogota (CO)

(73) Assignee: Schlumberger Technology Corporation, Sugar Land, TX (US)

( * ) Notice: Subject to any disclaimer, the term of this patent is extended or adjusted under 35 U.S.C. 154(b) by 479 days.

(21) Appl. No.: 13/402,748

(22) Filed: Feb. 22, 2012

(65) Prior Publication Data

US 2013/0213655 A1 Aug. 22, 2013

(51) Int. Cl.
*E21B 29/00* (2006.01)
*E21B 43/114* (2006.01)

(52) U.S. Cl.
CPC ..... *E21B 43/114* (2013.01); *Y10T 29/494* (2013.01)
USPC ..... 166/298; 166/55; 166/305.1

(58) Field of Classification Search
CPC ..... E21B 43/11; E21B 43/112; E21B 43/114; E21B 43/26; E21B 29/06; E21B 7/18; E21B 21/00; E21B 27/00; B23P 17/00
USPC ..... 166/298, 55, 305.1, 307, 311, 312, 99, 166/177.5, 222; 175/424; 29/890.09
See application file for complete search history.

(56) References Cited

U.S. PATENT DOCUMENTS

| | | | | |
|---|---|---|---|---|
| 7,497,259 | B2 | 3/2009 | Leising et al. | |
| 2007/0151734 | A1 * | 7/2007 | Fehr et al. | 166/305.1 |
| 2009/0242202 | A1 | 10/2009 | Rispler et al. | |
| 2010/0044041 | A1 | 2/2010 | Smith et al. | |
| 2010/0200230 | A1 | 8/2010 | East, Jr. et al. | |
| 2011/0088915 | A1 | 4/2011 | Stanojcic et al. | |
| 2011/0198082 | A1 | 8/2011 | Stromquist et al. | |

* cited by examiner

*Primary Examiner* — Yong-Suk (Philip) Ro
(74) *Attorney, Agent, or Firm* — Michael L. Flynn; Timothy Curington; Robin Nava

(57) ABSTRACT

A technique facilitates removal of excess sand during a jet perforating operation without requiring that the perforating string be pulled out of hole. A jet perforating tool is provided with at least one perforating nozzle for creating perforations in a well via high-pressure fluid. The jet perforating tool also comprises at least one wash nozzle oriented to direct fluid under pressure against a sand plug to break loose excess sand. A pair of seats and plug members may be used in the jet perforating tool to control the flow of pressurized fluid through the perforating jet nozzle and/or the wash nozzle.

12 Claims, 2 Drawing Sheets

HIGH PRESSURE JET PERFORATION SYSTEM

BACKGROUND

Many types of wells are perforated and stimulated to facilitate production of well fluids. Perforation techniques may involve the use of shaped charges or the use of high-pressure jets to create perforations through surrounding casing and into the formation. When using high pressure jets to create sequential perforations at different well zones, a sand plug is created downhole for a given well zone after each perforation and well stimulation operation. If the sand plug interferes with the region to receive the next set of perforations, the excess portion of the sand plug is removed. Difficulties can arise in removing the excess sand, and sometimes the perforating string needs to be pulled out of hole so that a motor/mill can be run in hole to break loose the excess sand.

SUMMARY

In general, the present disclosure provides a system and method which facilitate removal of excess sand during a jet perforating operation without requiring that the perforating string be pulled out of hole. A jet perforating tool is provided with at least one perforating nozzle for creating perforations in a well via high-pressure fluid. The jet perforating tool also comprises at least one wash nozzle oriented to direct fluid under pressure against a sand plug to break loose excess sand. A pair of seats and plug members may be used in the jet perforating tool to control the flow of pressurized fluid through the perforating jet nozzle and/or the wash nozzle.

BRIEF DESCRIPTION OF THE DRAWINGS

Certain embodiments will hereafter be described with reference to the accompanying drawings, wherein like reference numerals denote like elements. It should be understood, however, that the accompanying figures illustrate only the various implementations described herein and are not meant to limit the scope of various technologies described herein, and.

DETAILED DESCRIPTION

Figure 1:
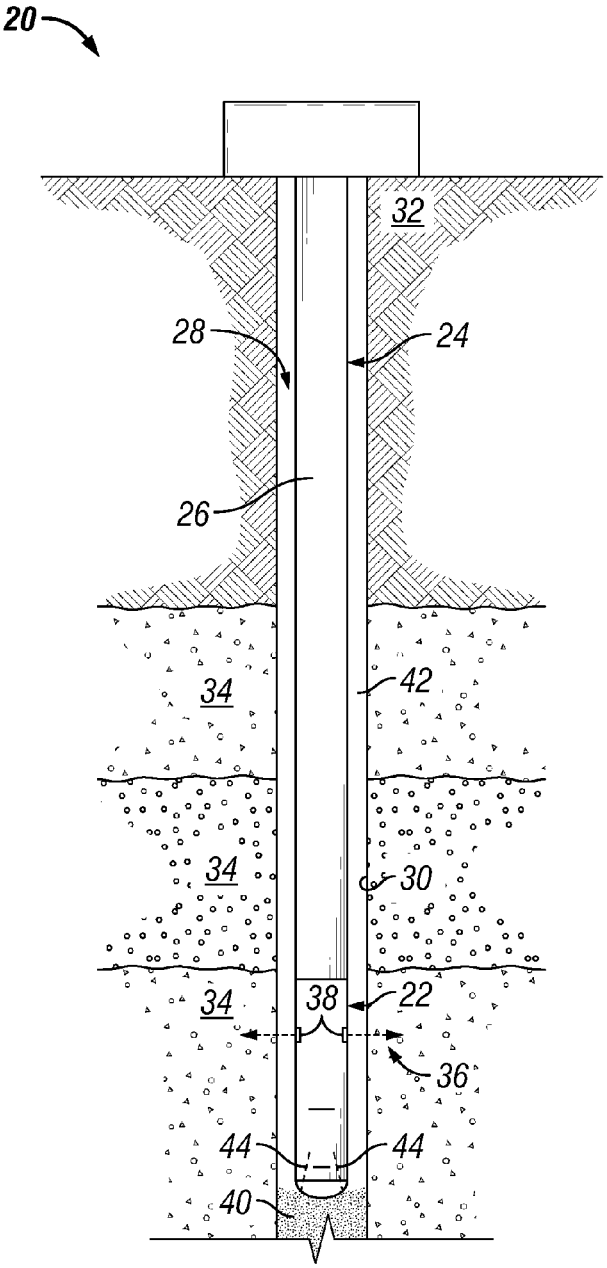
FIG. 1 is a schematic illustration of an example of a well system comprising a jet perforating tool, according to an embodiment of the disclosure.

In the following description, numerous details are set forth to provide an understanding of some illustrative embodiments of the present disclosure. However, it will be understood by those of ordinary skill in the art that the system and/or methodology may be practiced without these details and that numerous variations or modifications from the described embodiments may be possible.

The disclosure herein generally relates to a system and methodology which facilitate removal of excess sand from a sand plug to enable creation of a subsequent set of perforations with a jet perforating tool. The removal of excess sand may be accomplished during a jet perforating operation without requiring that the perforating string be pulled out of hole.

The jet perforating tool comprises a perforating nozzle for creating perforations in a well via high-pressure fluid which may be directed through a surrounding casing and/or other well components and into the formation. The jet perforating tool also comprises a wash nozzle which may be used to direct fluid under pressure against a sand plug to break loose excess sand, thus allowing the excess sand to be removed, e.g. reverse circulated, from the sand plug area. In many applications, a plurality of perforating nozzles and a plurality of wash nozzles are used in the jet perforating tool to create multiple pressurized fluid streams.

In some applications, a slurry of fluid and solids is directed at high differential pressures through the jet perforating tool. The resulting high velocity fluid stream is capable of perforating casing, liner, cement, debris, and other materials before entering into the formation rock. After formation of the perforations, a stimulation operation, such as a fracturing operation, can be performed. By way of example, a fracturing operation may be performed by directing fracturing fluid downhole through an annulus formed between the well casing and the coiled tubing on which the jet perforating tool is deployed.

A sand plug may be placed in the wellbore after the stimulation procedure to create isolation between stimulation stages. For example, the sand plug may be placed by adding sand to a flush fluid following a fracturing treatment. Excess sand may be cleaned up through the coiled tubing string by reverse circulating, thus reducing the volume of fluid used and the time incurred during cleanouts. However, if the excess sand has become compacted or otherwise difficult to remove, the wash nozzle or nozzles of the jet perforating tool can be used to break loose the excess sand of the sand plug. The loosened, excess sand may then be removed via reverse circulation.

In some fracturing applications, for example, a fracture operation is performed after a first jetting, e.g. after formation of the first set of perforations, and depending on the fracture geometry it is possible to have high wellhead pressure. This high wellhead pressure can cause the sand plug to consolidate, thus creating difficulty in cleaning out the sand and dressing the sand plug by reverse circulation cleaning without first breaking loose the excess consolidated sand. The jet perforating tool can be used to direct fluid under pressure through the wash nozzles to help remove the excess sand from the consolidated layer without having to pull the perforating string out of hole.

In general, compaction of the sand plug isolating fracture stages can be caused by a variety of factors, including high fracturing pressure or overpressure of the sand plug when a pressure test is performed. In these situations, removal of any excess sand via reverse circulating can become very difficult. The ability to selectively use the jet perforating tool to remove the excess sand without pulling the perforating string out of hole greatly enhances the efficiency of the perforating and stimulating operation.

Referring generally to FIG. 1, an example of one type of application utilizing a perforating string to facilitate perforating and stimulating of a plurality of well zones is illustrated. The example is provided to facilitate explanation, and it should be understood that a variety of perforating systems, stimulation systems, and other well or non-well related systems may utilize the methodology described herein. The well string and the jet perforating tool may comprise a variety of components arranged in various configurations depending on the parameters of a specific perforating/stimulating operation.

In FIG. 1, an embodiment of a well perforating and stimulating system 20 is illustrated as comprising a jet perforating tool 22 deployed on a tubing string 24, such as a coiled tubing string having coiled tubing 26. Additionally, the tubing string 24 may comprise a variety of additional and/or alternate components, depending in part on the specific perforating and stimulating application, the geological characteristics, and the well type. In the example illustrated, the tubing string 24 is deployed in a wellbore 28, illustrated as a generally vertical wellbore 28 lined with a casing 30. However, various types of downhole equipment may be used in the well perforating and stimulating system 20. Additionally, the tubing string 24 may be deployed in other types of wellbores, including deviated, e.g. horizontal, single bore, multilateral, cased, and uncased (open bore) wellbores.

In the example illustrated, wellbore 28 extends down through a subterranean formation 32 having a plurality of well zones 34. Each of the well zones 34 may be selectively perforated to form a plurality of perforations 36. Additionally, each of the well zones 34 may be stimulated, e.g. fractured, via an appropriate stimulation operation following perforation of the well zone 34. In the example illustrated, perforations 36 are formed by high-pressure jets of fluid discharged through at least one perforating jet nozzle 38 of jet perforating tool 22. In the example illustrated, the jet perforating tool 22 comprises a plurality of perforating jet nozzles 38 which direct perforating jets of fluid laterally, e.g. radially, outward through casing 30 and into the formation 32 at the desired well zone 34.

After perforating a desired well zone 34, a sand plug 40 may be formed by delivering sand downhole through, for example, an annulus 42 formed between tubing string 24 and well casing 30. In a perforating and fracturing operation, for example, the sand plug is created after stimulating each zone to establish isolation between fracture stages. In this example, the sand plug may be placed in the previously perforated and stimulated well zone to block the perforations 36 and to thus isolate that region of the wellbore for performance of the perforating and stimulating operation at the next sequential well zone 34. In at least some fracturing operations, the sand plug 40 may be formed by adding sand to the flush fluid delivered downhole after the fracturing treatment.

If excess sand is delivered downhole, it is desirable to clean or remove the excess sand before the next stage of perforating and stimulating. As discussed above, however, the excess sand may become compacted and difficult to remove via reverse circulation at least prior to loosening the compacted excess sand. It should be noted that in many applications, reverse circulation is achieved by circulating fluid down through annulus 42 and up through an internal flow passage of tubing string 24 to remove the excess sand. However, other techniques may be applied to remove the excess sand from the zone to be perforated. In the embodiment illustrated, jet perforating tool 22 comprises at least one wash nozzle 44 through which a pressurized stream of fluid may be directed to break up and loosen the excess compacted sand from sand plug 40. For example, fluid may be directed down through tubing string 24 and through a plurality of wash nozzles 44 which are oriented to direct the pressurized fluid against the excess sand of sand plug 40. Once loosened, the excess sand can be reversed circulated from the region to facilitate the next perforating and stimulating procedure.

Figure 2:
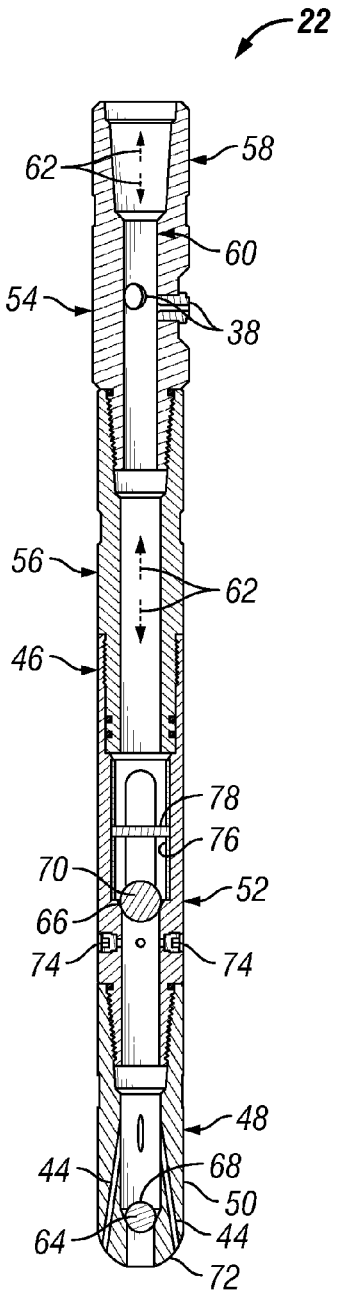
FIG. 2 is a cross-sectional view of an example of a jet perforating tool, according to an embodiment of the disclosure.

Referring generally to FIG. 2, an embodiment of jet perforating tool 22 is illustrated. In this embodiment, the jet perforating tool 22 comprises a tool housing 46 which may be made up of a plurality of sections join together by, for example, threaded engagement. In the example illustrated, the tool housing 44 comprises a lead end 48 which may be formed as a bull nose 50 designed to guide the jet perforating tool 22 along the wellbore 28. The lead end 48 may be coupled with a reverse check valve assembly section 52 which, in turn, is coupled to a perforating jet section 54 via a sub section 56. The perforating jet section 54 also may be coupled with a mechanical connection end 58 designed to enable coupling of the jet perforating tool 22 into tubing string 24. Depending on the specific application, however, the various sections used to form tool housing 46 and jet perforating tool 22 may be substituted, reconfigured, or otherwise changed to facilitate a given perforation and stimulation operation.

In the example illustrated, a primary internal flow passage 60 is disposed longitudinally through an interior of tool housing 46 to enable flow of fluids, e.g. reverse circulation fluids and high-pressure jetting fluids, through the jet perforating tool 22, as represented by arrows 62. Along the primary internal flow passage 60, a first seat 64 is disposed in, for example, lead end 48. Additionally, a second seat 66 is disposed along the primary internal flow passage 60 in, for example, check valve assembly section 52. The first seat 64 and the second seat 66 may be selectively and sealingly engaged by corresponding first plug member 68 and second plug member 70, respectively. By way of example, the first plug member 68 and the second plug member 70 may be in the form of balls designed to seat and seal against the corresponding first seat 64 and second seat 66 to selectively block flow along primary internal flow passage 60.

In the embodiment illustrated, second seat 66 has a larger diameter than first seat 64. The seat diameters are selected so that the first plug member 68, e.g. the first ball or plug member 68, passes through the second seat 66 and engages and seals against first seat 64 when delivered through jet perforating tool 22 along the primary internal flow passage 60. The second ball or plug member 70, e.g. the second plug member 70, has a larger diameter than the first plug member 68 so as to engage and seal against the second seat 66.

The wash nozzle or nozzles 44 may be disposed in lead end 48 such that the nozzles extend from primary internal flow passage 60 to an exterior 72 of the jet perforating tool 22. Although the wash nozzles 44 may be arranged in a variety of orientations, the illustrated example provides a plurality of the wash nozzles 44 extending from primary internal flow passage 60 in a generally forward direction (e.g. generally parallel to a longitudinal axis defined by the flow passage 60) to a location along exterior 72 ahead of first seat 64, i.e. on an opposite side of first seat 64 relative to second seat 66. This allows pressurized fluid to be discharged in the forward direction toward the excess compacted sand of sand plug 40 when first plug member 68 is delivered into engagement with first seat 64. The first plug member 68 is used to block flow of pressurized fluid through primary internal flow passage 60 so as to force the pressurized fluid through wash nozzles 44 and against the sand plug 40. The wash nozzles 44, e.g. four wash nozzles, are designed to give the discharged fluid enough velocity to jet the consolidated layer of excess sand with sufficient power to deconsolidate the excess sand. It should be noted that in some applications, additional nozzles 74 may be deployed between first seat 64 and second seat 66 to facilitate removal of sand.

The second plug member 70 also may be selectively delivered downhole through jet perforating tool 22 along primary internal flow passage 60. Second plug member 70 is delivered into engagement with second seat 66 to enable discharge of high-pressure fluid through the perforating jet nozzle or nozzles 38. For example, second plug member 70 may be delivered downhole into engagement with second seat 66 prior to a perforation procedure in which high-pressure fluid is delivered down through primary internal flow passage 60 for discharge in a lateral, e.g. radial, direction to form perforations 36 in a desired well zone 34. In some applications, the second plug member 70 may be retained in a plug cavity 76 by a retention member 78, such as a pin. However, the retention member 78 is omitted or removed in applications when second plug member 70 is reversed circulated out of jet perforating tool 22 to enable deployment of first plug member 68 down through primary internal flow passage 60 to first seat 64.

Figure 3:
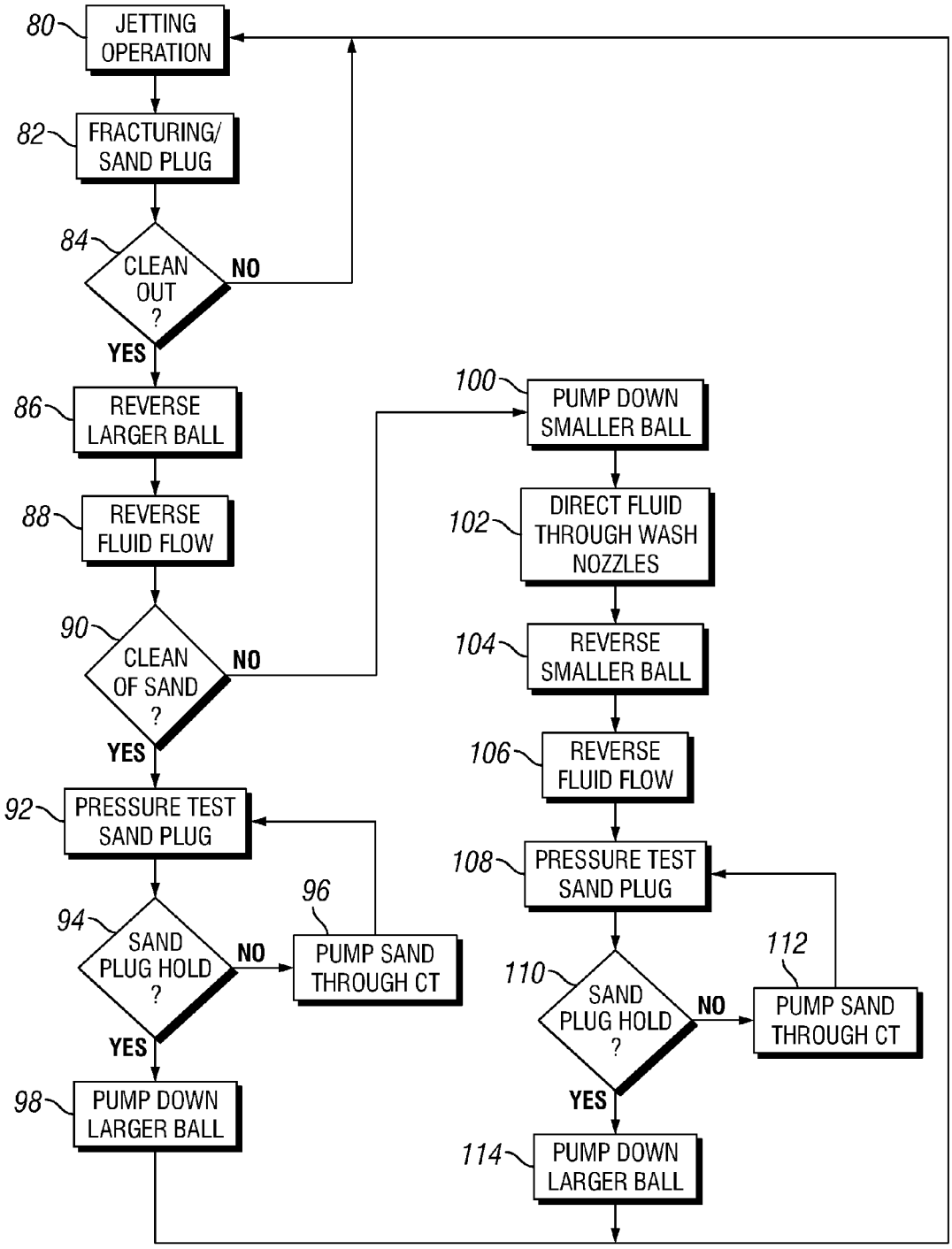
FIG. 3 is a flowchart illustrating an example of a methodology for creating perforations and removing excess sand from sand plugs if needed, according to an embodiment of the disclosure.

The jet perforating tool 22 and the overall well perforation and stimulation system 20 may be used in a variety of applications. However, an example of a perforating and fracturing application is described with reference to FIG. 3 to facilitate explanation of the jet perforating tool 22 and a methodology for operating the jet perforating tool 22. In this example, an initial jetting operation is performed downhole at an initial well zone 34, e.g. the lowermost well zone, as represented by block 80. The jetting operation involves discharge of high pressure fluid jets through perforating jet nozzles 38 to create perforations 36. A stimulation and sand plug operation is then performed, as represented by block 82. For example, a fracturing procedure may be performed by pumping fracturing fluid into the perforations 36 to fracture the surrounding formation. Sand is then delivered downhole with the flush fluid after the fracturing treatment to create the sand plug 40.

Once the sand plug 40 is formed, a determination is made whether a cleanup is required, as represented by block 84. If no sand removal is required, the subsequent jetting operation may be performed at the next subsequent well zone 34 (see block 80); although in some applications, pressure tests may be formed on the sand plug to verify sand plug integrity prior to perforating the next well zone. If, on the other hand, cleanout is required, a reverse circulation is initiated to reverse out the larger, second plug 70, e.g. ball, (see block 86) and to establish a reverse circulation fluid flow, as represented by block 88. A determination is then made as to whether the reverse circulation has been successful in cleaning out the excess sand, as represented by decision block 90.

If the region is sufficiently clean of sand, a pressure test may be performed on the sand plug 40, as represented by block 92, and a determination is made as to whether the sand plug holds the pressure, as represented by decision block 94. If the sand plug 40 does not hold, additional sand may be pumped down through the coiled tubing 26, as represented by block 96. The sand plug 40 is then again pressure tested (see block 92). If the sand plug holds under pressure testing, the larger, second plug member 70 may be pumped down into engagement with the corresponding second seat 66, as represented by block 98. Once the second plug member 70 is seated, pressurized fluid may be applied against the second plug member 70 such that high-pressure fluid jets are discharged through perforating jet nozzles 38 for perforation of the next sequential well zone 34 (see block 80).

Returning to decision block 90, if the reverse circulation fluid flow is unsuccessful in cleaning the excess sand, the smaller first plug member 68 is pumped down coiled tubing 26, through primary internal flow passage 60 of jet perforating tool 22, and into engagement with first seat 64, as represented by block 100. Once the first plug member 68 is properly seated against first seat 64, pressurized fluid may be directed down through coiled tubing 26, along primary internal flow passage 60, and out through wash nozzles 44, as indicated by block 102. The high-pressure stream of fluid discharged from the wash nozzles 44 deconsolidates the excess sand of the sand plug 40 for removal without pulling the perforating string 24 out of hole.

Once the excess sand is loosened, a reverse circulation of fluid is initiated to reverse out the first plug member 68, e.g. ball, (see block 104) and to establish a reverse circulation fluid flow, as represented by block 106. Following the reverse circulation stage, a pressure test is performed on the sand plug 40, as represented by block 108. A determination is then made as to whether the sand plug is able to hold the pressure, as represented by decision block 110. If the sand plug does not hold, additional sand may be pumped down through the coiled tubing 26, as represented by block 112. The sand plug is then again pressure tested (see block 108). If the sand plug holds under pressure testing, the larger, second plug member 70 may be pumped down into engagement with the corresponding second seat 66, as represented by block 114. Once the second plug member 70 is seated, pressurized fluid may be applied against the second plug member 70 such that high-pressure fluid jets are discharged through perforating jet nozzles 38 for perforation of the next sequential well zone 34 (see block 80).

The system and methodology described herein may be employed in non-well related applications which require deconsolidation of compacted material. Similarly, the system and methodology may be employed in many types of well applications, including many types of vertical and lateral well applications involving perforating procedures combined with various stimulation procedures, e.g. fracturing procedures, chemical injection procedures, proppant procedures, or other stimulation procedures. Furthermore, other types of well string components may be added, substituted and/or modified with respect to the overall well system 20 to facilitate perforation and stimulation operations in a variety of environments. Components of the jet perforating tool 22 also may be added, substituted and/or modified to facilitate a given perforating and stimulating operation without requiring that the tubing string be pulled out of hole.

Although only a few embodiments of the system and methodology have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method for creating sequential perforations along a wellbore with high-pressure jets, comprising:

forming a first set of perforations in a wellbore with a jet perforating tool;

creating a sand plug in the wellbore;

removing excess sand from the sand plug by directing a first ball to a first ball seat at a lead end of the jet perforating tool discharging fluid through wash nozzles to loosen the excess sand; and reverse circulating the first ball and the excess sand;

directing a second ball of larger diameter than the first ball to a second ball seat located to segregate the wash nozzles; and applying pressurized fluid against the second ball such that fluid is discharged from perforating jet nozzles to form a second set of perforations.

2. The method as recited in claim 1, further comprising performing a fracturing operation after formation of the first set of perforations and again after formation of the second set of perforations.

3. The method as recited in claim 1, further comprising pressure testing the sand plug after removing excess sand.

4. The method as recited in claim 1, wherein after forming the first set of perforations the second ball is reverse circulated out of the jet perforating tool to allow the first ball to be dropped and directed to the first ball seat.

5. The method as recited in claim 1, further comprising locating the wash nozzles in a bull nose section of the jet perforating tool.

6. The method as recited in claim 1, wherein applying comprises discharging the fluid under sufficient pressure to form perforations through a well casing surrounding the jet perforating tool.

7. The method as recited in claim 6, wherein applying comprises discharging the fluid under sufficient pressure to form perforations into a formation surrounding the well casing.

8. The method as recited in claim 1, further comprising forming additional sets of perforations and creating additional sand plugs along the wellbore.

9. The method as recited in claim 1, wherein applying comprises flowing the fluid down through coiled tubing.

10. A system for creating perforations, comprising:

a jet perforating tool positionable in a wellbore having a primary internal flow passage, a lead end with a first seat along the primary internal flow passage, and a wash nozzle directing a fluid flow from the primary internal flow passage to an exterior of the jet perforating tool in a forward direction generally parallel to the primary internal flow passage, the jet perforating tool further comprising a perforating jet nozzle directing a fluid flow from the primary internal flow passage to an exterior of the jet perforating tool in a direction radial to the primary internal flow passage and a second seat disposed between the wash nozzle and the perforating jet nozzle, wherein the first seat is sized to sealingly engage a plug member which is configured to be flowed down along the primary internal flow passage and through the second seat.

11. The system as recited in claim 10, wherein the jet perforating tool is coupled into a perforating string comprising coiled tubing.

12. The system as recited in claim 11, wherein the wash nozzle comprises a plurality of wash nozzles and the perforating jet nozzle comprises a plurality of perforating jet nozzles.

* * * * *